US008794743B2

(12) United States Patent
Zuo et al.

(10) Patent No.: US 8,794,743 B2
(45) Date of Patent: Aug. 5, 2014

(54) MULTI-FILM ADHESIVE DESIGN FOR INTERFACIAL BONDING PRINTHEAD STRUCTURES

(75) Inventors: Yanjia Zuo, Webster, NY (US); James M. Casella, Webster, NY (US); Santokh S. Badesha, Pittsford, NY (US); Peter J. Nystrom, Webster, NY (US); Antonio L. Williams, Rochester, NY (US); Thomas J. Wyble, Williamson, NY (US); Mandakini Kanungo, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 35 days.

(21) Appl. No.: 13/307,231

(22) Filed: Nov. 30, 2011

(65) Prior Publication Data

US 2013/0135391 A1 May 30, 2013

(51) Int. Cl.
*B41J 2/14* (2006.01)

(52) U.S. Cl.
USPC ..... 347/47

(58) Field of Classification Search
CPC ..... B41J 2/162; B41J 2/1623
USPC ..... 347/71, 72, 102, 47
See application file for complete search history.

(56) References Cited

U.S. PATENT DOCUMENTS

| | | | | |
|---|---|---|---|---|
| 6,382,777 | B1 * | 5/2002 | Yamaguchi et al. | 347/63 |
| 6,450,622 | B1 * | 9/2002 | Nguyen et al. | 347/63 |
| 6,787,049 | B2 * | 9/2004 | Tom et al. | 216/27 |
| 6,869,171 | B2 * | 3/2005 | Nishikawa et al. | 347/68 |
| 6,966,630 | B2 * | 11/2005 | Sasaki et al. | 347/45 |
| 7,021,550 | B2 * | 4/2006 | Uchihiro et al. | 235/492 |
| 7,025,453 | B2 * | 4/2006 | Ylitalo et al. | 347/105 |
| 7,073,902 | B2 * | 7/2006 | Codos et al. | 347/102 |
| 7,271,697 | B2 * | 9/2007 | Whittaker et al. | 336/229 |
| 7,922,860 | B2 * | 4/2011 | Yoshizawa et al. | 156/330 |
| 2002/0044179 | A1 * | 4/2002 | Okazawa et al. | 347/68 |
| 2002/0063757 | A1 * | 5/2002 | Kanda et al. | 347/71 |
| 2003/0035043 | A1 * | 2/2003 | Sugiyama et al. | 347/171 |
| 2003/0112298 | A1 * | 6/2003 | Sato et al. | 347/68 |
| 2003/0117463 | A1 * | 6/2003 | Kitahara | 347/68 |
| 2004/0085396 | A1 * | 5/2004 | Ahne et al. | 347/43 |
| 2007/0165076 | A1 * | 7/2007 | Imken et al. | 347/58 |
| 2008/0239022 | A1 * | 10/2008 | Andrews et al. | 347/71 |
| 2009/0190968 | A1 * | 7/2009 | Mestha et al. | 399/266 |
| 2009/0315946 | A1 * | 12/2009 | Koseki | 347/47 |
| 2010/0040829 | A1 * | 2/2010 | Lin et al. | 428/131 |
| 2010/0097431 | A1 * | 4/2010 | Takakuwa | 347/68 |
| 2010/0149296 | A1 * | 6/2010 | Cornell et al. | 347/102 |
| 2010/0202800 | A1 * | 8/2010 | Sowa et al. | 399/218 |
| 2011/0141206 | A1 * | 6/2011 | Cheung et al. | 347/71 |
| 2011/0304671 | A1 * | 12/2011 | Law et al. | 347/44 |

OTHER PUBLICATIONS

Saeed et al., Apr. 19, 2006, European Polymer Journal, p. 1852-53.*

* cited by examiner

*Primary Examiner* — Matthew Luu
*Assistant Examiner* — Patrick King
(74) *Attorney, Agent, or Firm* — MH2 Technology Law Group LLP

(57) ABSTRACT

In accordance with aspects of the present disclosure, a printhead assembly arranged to dispense ultraviolet curable ink or gel ink and method thereof is disclosed. The printhead assembly includes a plurality of functional plates stacked together; a first adhesive layer arranged between adjacent functional plates to provide bonding between the plates; and a second adhesive layer arranged between adjacent function plates to provide chemical resistance to the ultraviolet curable ink or the gel ink.

7 Claims, 8 Drawing Sheets

| COUPON TYPE | WEEK | X (mm) | Y (mm) | D (mm) | ΔX (mm) | ΔY (mm) | ΔD (mm) |
|---|---|---|---|---|---|---|---|
| LAB AIR | 0 | 31.756 | 25.32822 | 0.759513 | 0.00% | 0.00% | 0.00% |
| | 1 | 31.69687 | 25.34766 | 0.75259 | -0.19% | 0.08% | -0.91% |
| | 2.8 | 31.65819 | 25.32069 | 0.754386 | -0.31% | -0.03% | -0.68% |
| | 4 | 31.68269 | 25.33404 | 0.753871 | -0.23% | 0.02% | -0.74% |

| COUPON TYPE | WEEK | X (mm) | Y (mm) | D (mm) | ΔX (mm) | ΔY (mm) | ΔD (mm) |
|---|---|---|---|---|---|---|---|
| HOT UV INK | 0 | 31.756 | 25.32822 | 0.759513 | 0.00% | 0.00% | 0.00% |
| | 1 | 31.77482 | 25.38192 | 0.751401 | 0.06% | 0.21% | -1.07% |
| | 2.8 | 31.72677 | 25.31228 | 0.759371 | -0.09% | -0.06% | -0.02% |
| | 4 | 31.71845 | 25.31792 | 0.760912 | -0.12% | -0.04% | 0.18% |

| MATERIAL | PRESS CONDITIONS | | | DIMENSION | | | % CHANGE | FAILURE TYPE | PEEL STRENGTH | |
|---|---|---|---|---|---|---|---|---|---|---|
| | PRESS (psi) | TEMP (C) | TIME (min) | TYPE | BEFORE | AFTER | | | | |
| RESIN DESIGN -B STAGE- | 100 | 180 | 60 | X (mm): | 14 | 23 | 64.3% | ADHESIVE | LOW | |
| | 100 | 180 | 60 | Y (mm): | 16.5 | 27 | 63.6% | | | |
| | 100 | 180 | 60 | THICKNESS (in): | 0.002 | 0.0012 | -40.0% | | | |
| RESIN DESIGN -B STAGE- | 35 | 180 | 60 | X | 19 | 21 | 10.5% | ADHESIVE | LOW | |
| | 35 | 180 | 60 | Y | 20 | 32 | 60.0% | | | |
| | 35 | 180 | 60 | THICKNESS | 0.002 | 0.0015 | -25.0% | | | |
| R1500 | 100 | 190 | 70 | X | 27 | 27 | 0.0% | COHESIVE | HIGH | |
| | 100 | 190 | 70 | Y | 20 | 20 | 0.0% | | | |
| | 100 | 190 | 70 | THICKNESS | 0.002 | 0.002 | 0.0% | | | |

EDGE CUT THROUGH FILM LIMITED TRAVEL

FIG. 4

MULTI-FILM ADHESIVE DESIGN FOR INTERFACIAL BONDING PRINTHEAD STRUCTURES

DESCRIPTION OF THE INVENTION

1. Field of the Invention

Aspects of the present disclosure are related to printhead assemblies and in particular to adhesive bonding materials used in a composite manner to laminate printhead structures using a two film method.

2. Background of the Invention

Solid ink jet printing machines include printheads that include one or more ink-filled channels communicating at one end with an ink supply chamber or reservoir and having an orifice at the opposite end, commonly referred to as the nozzle. An energy generator, such as a piezo-electric transducer, is located within the channels near the nozzle to produce pressure pulses. Another type system, known as thermal ink jet or bubble jet, produces high velocity droplets by way of a heat generating resistor near the nozzle. Printing signals representing digital information originate an electric current pulse in a resistive layer within each ink passageway near the orifice or nozzle, causing the ink in the immediate vicinity to evaporate almost instantaneously and create a bubble.

Ink jet printheads typically require multiple layers of materials as part of their fabrication. Traditional methods use layers of gold plated stainless steel sheet metal with photo chemically etched features which are brazed together to form robust structures. However, with the continued drive to improve cost and performance, use of alternate materials and bonding processes are required. Polymer layers can replace certain sheet metal components, but polymers require adhesives to bond to each other or to metal layers. Compatibility of these adhesives with the various chemistries used in ultraviolet (UV) and UV gel inks can be problematic including the case with the acrylic monomers in the UV curable inks and a baseline acrylic adhesive, such as R1500. When chemistry matching like this occurs, the R1500 adhesive swells, loses bond strength and ultimately delaminates causing color to color mixing along with poor jetting performance. The swelling of R1500 can also cause non-flatness of the nozzle plate to occur, which causes misdirectional jetting along with poor jetting performance.

What is needed is an improved method of adhesive bonding materials used in a composite manner to laminate printhead structures.

SUMMARY OF THE INVENTION

In accordance with various embodiments of the present disclosure, a printhead assembly arranged to dispense ultraviolet curable ink or gel ink is disclosed. The printhead can include a plurality of functional plates stacked together; a first adhesive layer arranged between adjacent functional plates to provide bonding between the plates; and a second adhesive layer arranged between adjacent functional plates to provide chemical resistance to the ultraviolet curable ink or the gel ink.

The first adhesive layer can have a thickness of between about 1 mil and 4 mils. The second adhesive layer has a thickness of between about 1 mil and 4 mils.

The first adhesive layer can include a crosslinkable acrylic adhesive or a thermoplastic polyimide. The second adhesive layer can include epoxies or thermoplastic polyimide.

The functional plates can be formed of a metal, ceramic or plastic material.

In accordance with various embodiments of the present disclosure, a method for fabricating a printhead assembly for ultraviolet curable ink or gel ink jet printing machine in which the printhead includes a plurality of functional plates stacked together is disclosed. The method can include applying a first adhesive at a first area between layers of the functional plates to provide bonding strength; applying a second adhesive at a second area between layers of the functional plates to provide chemical resistance to the ultraviolet curable ink or the gel ink; and forming the stack of functional plates with the bonded and chemical resistant functional plates.

In accordance with various embodiments of the present disclosure, a method for adhering two or more components of an ultraviolet curable ink or gel ink inkjet printhead is disclosed. The method can include applying a first adhesive material to a first portion of a outward surface of a first component of the printhead to provide mechanical bonding strength; applying a second adhesive material to second portion of the outward surface of the first component of the printhead to provide chemical resistance to the ultraviolet curable ink or the gel ink; and arranging the first component of the printhead with a second component of the printhead to provide bonding between first component and the second component.

The first adhesive can include a crosslinkable acrylic adhesive or a thermoplastic polyimide. The second adhesive can include a liquid epoxy that is chemically resistant to the ultraviolet curable ink or the gel ink.

The components can include a compliant wall, an external manifold attach, a heater attach and a Boss plate adhesive.

In some aspects, the first adhesive applied at a first area between layers of the functional plates can satisfy all other functional requirements except the chemical resistance and the second adhesive applied at a second area between layers of the functional plates can provide all functional requirements including chemical resistance to the ultraviolet curable ink or the gel ink except low storage modulus.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

FIG. 4 shows a chart for squeeze out performance of Resin Design 12300 as compared to R1500.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Figure 1:
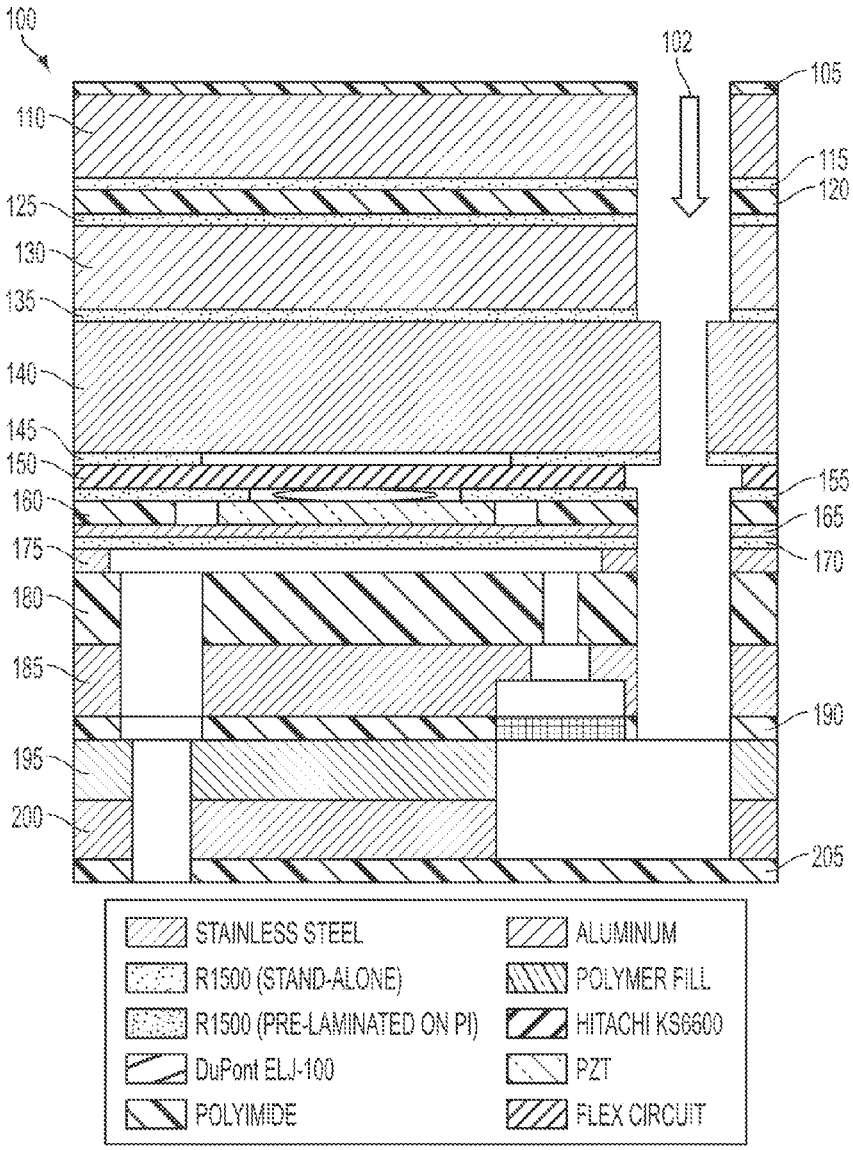
FIG. 1 PRIOR ART
FIG. 1 shows a conventional example of a printhead assembly for ink printing machines.

FIG. 1 shows an example UV printhead assembly 100 for UV ink printing machines. Assembly 100 comprises a series of functional plates, each performing an ascribed function for controlled dispensing of the molten ink onto a substrate passing by the assembly. In a particular embodiment, the printhead assembly 100 comprises an ink flow path 102 that passes through layers of stackup comprising P1 complaint wall 105 (0.0003" thickness of polyimide) arranged on top of A1 external manifold 110 (0.1185" thickness of aluminum). R1500 external manifold adhesive 115 (0.002" thickness of R1500 stand-alone) is arranged to adhere A1 external manifold 110 to Kapton DC heater 120 (0.003" thickness of polyimide). R1500 heater adhesive 125 (0.002" thickness of R1500 stand-alone) is arranged to adhere Kapton DC heater 120 to diverter 130 (0.050" thickness of aluminum). R1500 diverter adhesive 135 (0.001" thickness Of R1500 stand-alone) is arranged to adhere diverter 130 to SS boss plate 140 (0.009" thickness of stainless steel). R1500 boss plate adhesive 145 (0.001" R1500 stand-alone) is arranged to adhere SS boss plate 140 to Kapton flex 150 (0.003" thickness of flex circuit). R1500 standoff 155 (0.001" thickness of R1500 stand-alone) is arranged on a top surface of P1 PZT spacer 160 (0.002" thickness of polyimide). R1500 diaphragm adhesive 170 (0.001" thickness of R1500 stand-alone) is arranged to adhere SS diaphragm 165 (0.0008" thickness of stainless steel) to SS body 175 (0.003" thickness of stainless steel). P1 vertical inlet 185 (0.007" thickness of polyimide) is arranged below SS body 175 and on top of SS separator 185 (0.006" thickness of stainless steel). P1 rockscreen 190 (0.002" thickness of polyimide) is arranged below SS separator 185 and on top of SS manifold A 195 (0.006" of stainless steel). SS manifold B 200 (0.006" thickness of stainless steel) is arranged below SS manifold A 195 and on top of P1 aperture 205 (0.002" thickness of polyimide).

To bond any combination of stainless, aluminum or polyimide layers requires a thin film adhesive, such as R1500, which is a commercially available adhesive from Rogers Corporation. This adhesive, when used at the 0.002" thickness, also has the ability to take up surface flatness non-uniformities, a necessary requirement at the manifold and heater interfaces.

When printheads using the R1500 baseline adhesive are used with hostile UV curable inks, the acrylate monomers in the ink can attack the acrylics in the adhesives over time. This matching of chemistries causes material swelling, which reduces both the inlet diameter and flow as well as causes material delamination at the material interfaces. This failure mechanism results in weak and missing jets, misdirectional jetting, and color mixing. The chemistry of these inks, in terms of percent weight, is composed mostly of a Di acrylate monomer (50-80%) and a multi functional acrylate co-monomer (5-25%). Initial testing has shown these monomers to be incompatible with the acrylic used in the baseline R1500 adhesive.

Figure 2:
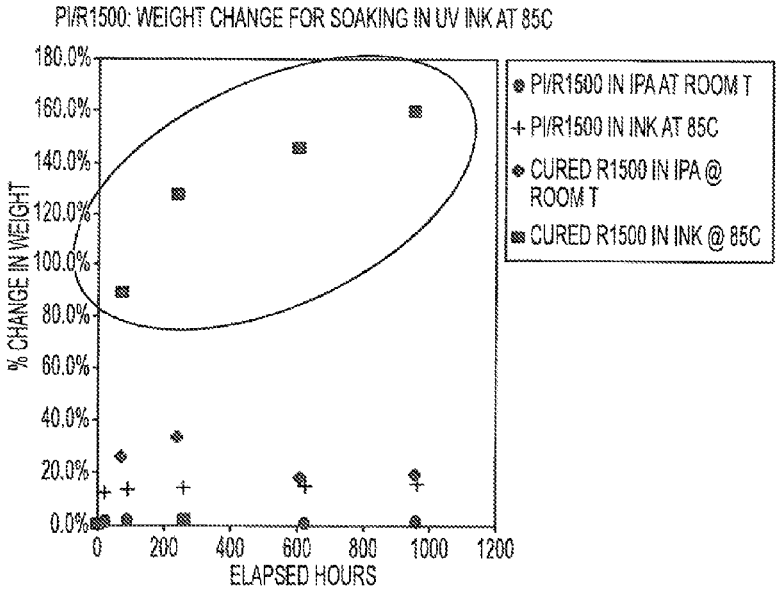
FIG. 2 shows a plot of percent weight gain for R1500 adhesive when subjected to a UV ink bath.

FIG. 2 shows the weight gain results of a hot UV ink bath soak test for which a cured coupon of R1500 was soaked at 85° C. over time. At 980 hours, the R1500 coupon experienced 160% weight gain along with 48% dimensional change in the thickness direction. Given its high absorption and physical dimensional change, R1500 (which is classified as an acrylic adhesive) has been identified as a poor bonding adhesive for printheads designed for curable UV ink applications. Besides the baseline R1500 adhesive failure, other off the shelf commercially available adhesive products has also failed in like manner. Table 1 list these materials, their adhesive class description, and their resulting percent weight gain, interesting to note is the face that 2 of the 3 are modified acrylics and the third is a nitrile-phenolic.

TABLE 1

Other B-stage adhesives when subjected to a 85° C. UV ink bath

| Company | Film # | Adhesive Type | % WG | Test Duration |
|---|---|---|---|---|
| DuPont | Pyralux FR0100 | modified acrylic | 68% | 2 weeks |
| MACtac | F4020A | nitrile-phenolic | 57% | 2 weeks |
| Shaldahi | Flexbase T1612 | modified acrylic | 145% | 10 days |

Table 2 below lists a set of functional requirements for B-staged adhesives that need to be considered to compatible with UV-type ink.

TABLE 2

B-stage Adhesive Requirements for UV type inks

1. B-staged thermally activated adhesive film
2. Cure <200° C./1 hr without wicking/squeeze out
3. Lap shear strength >200 psi bonding stainless to stainless
4. Tg >130° C.
5. Stable in solvents - Toluene, methanol, methyl ethyl ketone (MEK)
6. 5 year availability or longer
7. Thickness ~25 microns
8. Squeeze out to less than 5% along any direction at bonding temperature and a minimum 100 psi pressure
9. Maximum size of any filler particles to be less than 1 micron in diameter
10. Applicable for UV ink print head applications (for which the major solvents of interest are listed in #5)
11. Storage modulus in the 100 MPa to 1500 MPa range at 20° C. and 3 MPa to 700 MPa range at 120° C.

To reduce the difficulty in finding one adhesive which satisfies all the functional requirements listed in Table 2, a method of meeting these requirements is disclosed that divides the functional requirements into two sets. A first adhesive can be chosen to address compliance performance, or sometimes called elasticity and which is the inverse of hardness or stiffness, by choosing a material having a relatively low modulus. For example, the first adhesive can have a storage modulus between about 100 MPa and 1500 MPa range at about 20° C. and between about 3 MPa and 700 MPa range at about 120° C. A second adhesive can be chosen to address chemical resistance (swelling). Aspects of the present disclosure describe how utilizing two adhesives at any given layer, one for compliance (bonding) strength and one for chemical resistance, can be used for building low cost, high performance printheads. Printheads built in this manner can meet the demands not only for the hostile UV curable ink and gel ink application, but for all market ink chemistries as well. In some aspects, the two adhesives can be an epoxy film or a liquid dispensed adhesive.

Figures 3A, 3B:
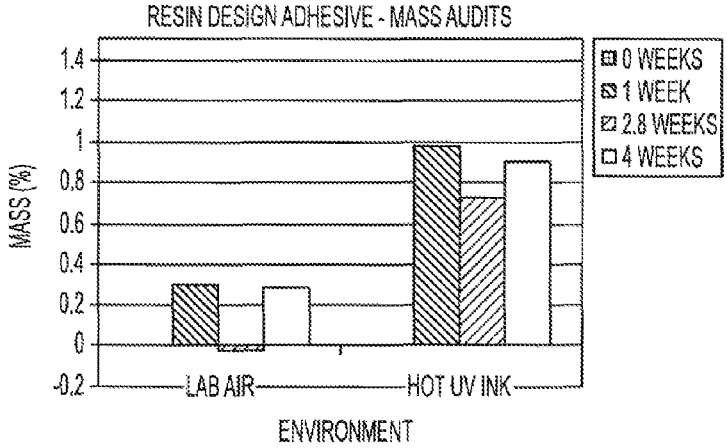
FIGS. 3*a* and 3*b* show an illustration of percent weight gain and dimensional change data for Resin Design 12300.

To illustrate the difficultly of a good chemically resistant adhesive that satisfies all eleven requirements listed in Table 2, Resin Design's 12300 epoxy thin film chemical compatibilty is shown in FIGS. 3*a* and 3*b* to be excellent (less than 1% weight gain and dimension change; however, its squeeze out performance (requirement #2) is poor, showing a change of 65% (see FIG. 4). TechFilm 12300 (TF-12300) is manufactured by TechFilm of Billerica, Mass. and includes BisPhenol A Epoxy Resin, Silica, Latent Curing Agent and Epoxy Cresol Novalac Resin.

Generally, aspects of the present disclosure are directed an integration of two adhesive materials (a thin B-stage film and a liquid adhesive) at any given layers in the upper jetstack. The baseline adhesive, such as R1500, is chosen to satisfy a first set of requirements in Table 2 with the exception of #5 (chemical resistance) and second adhesive material, such as Resin Design's 12300 or any other chemically compatible liquid epoxy formulation, is chosen to be arranged at a region where chemical compatibility with ink, such as UV curable ink, is required.

Figure 5:
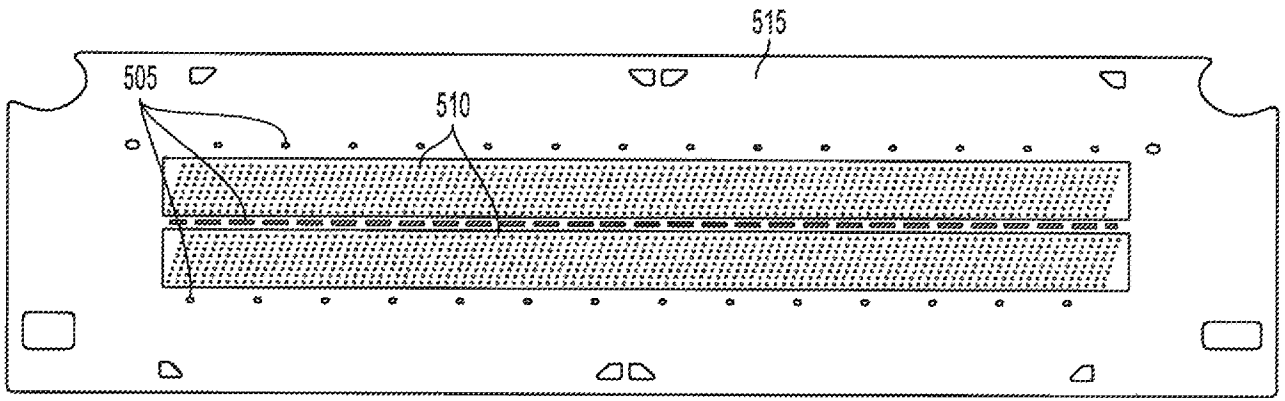
FIG. 5 shows an example of using two epoxy films on the same jetstack layer in accordance with aspects of the present disclosure.

FIG. 5 illustrates a two material approach using the "compliant wall" adhesive layer as an example which is also shown in FIG. 1. Ink inlets 505 provide an ink flow path through the jetstack layer. A first adhesive 510, such as R1500 Adhesive, can be provided to areas of the jetstack layer that are near ink inlets 505. A second adhesive 515, such as Resin Design Adhesive, can be provide to areas of the jetstack layer that are not near ink inlets 505 and do not have first adhesive 510.

In some configurations, the diameter of each ink inlet 505 can be about 1.5 mm. Depending on type of first adhesive and the diameter of the ink inlet 505, each ink inlet 505 may need to be enlarged about an additional 15 mils (1 mil=0.001 inch) on the radius to allow a bead of liquid epoxy to be deposited in a controlled fashion on a surface away from the inlet circumference. By way of a non-limiting example, since deposition needle diameters typically only go down to a minimum of 4 mils, the 2 mils R1500 layer can cause a 8 mil wide final bead width. This results in a total of about 15 mils extra space on the radius. It is also possible to reduce the 4 mils diameter epoxy bead further by adding a solvent (such as methylene chloride) to the liquid epoxy. This is typically done with sheet type coatings where a thin coating on the order of microns can be achieved given an original coating thickness of 25 microns and ½ a day or so of evaporation time. This approach can be implemented at any of the R1500 layers, such as the compliant wall, the external manifold attach, the heater attach and the Boss plate adhesive.

The first or baseline adhesive, such as R1500, can be used over the region where geometry details are small (the openings shown in the R1500 shaded regions enable electrical contact between the flex and PZT components. The remaining region of the standoff layer is made of the Resin Design epoxy resin adhesive which has been tested and shown itself to be chemically compatible with the UV inks. To prevent squeeze out into the ink inlets, the adhesive features can be oversized by roughly 15 mils on the radius. The R1500 stays in contact with the PZT's and not the higher modulus Resin Design Epoxy. To reduce or eliminate cross-talk between PZT, which is a print quality concern, the low modulus R1500 can be maintained in the in the appropriate region, as indicated in the Figure.

Figure 6:
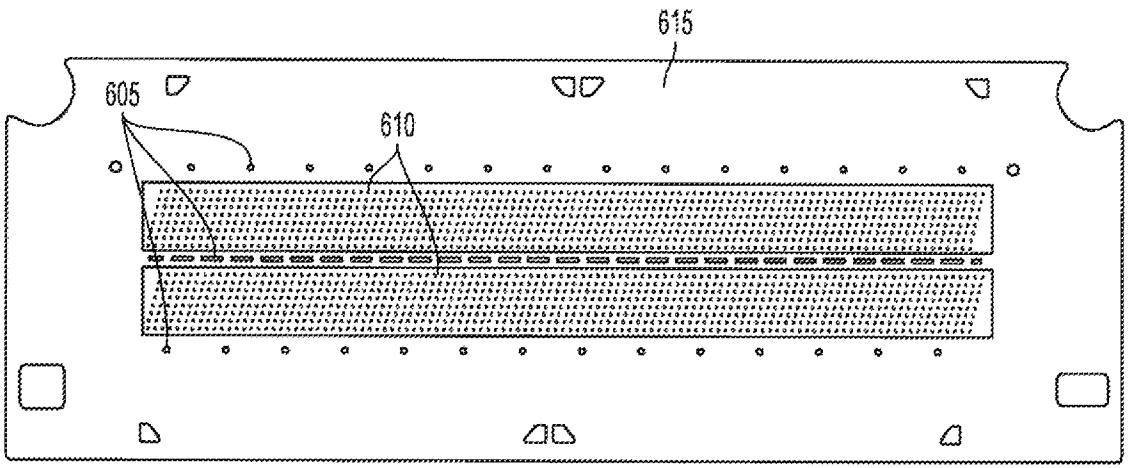
FIG. 6 shows another example method using two epoxy films on the same jetstack layer in accordance with aspects of the present disclosure.

FIG. 6 shows another example where for the same jetstack layer (stand off), the Resin Design Adhesive can be exchanged for a thin epoxy double coated polyimide film. Ink inlets 605 provide an ink flow path through the jetstack layer. A first adhesive 610, such as R1500 Adhesive, can be provided to areas of the jetstack layer that are near ink inlets 605. A second adhesive 615, such as a thin epoxy coated polyimide film, can be provide to areas of the jetstack layer that are not near ink inlets 605 and do not have first adhesive 610. The thin epoxy coated polyimide film can be achieved using a solvent-epoxy mixture to attain the proper coating setpoints and then coated onto polyimide film at about a 25 micron thickness using a draw bar fixture. The film can be dried at room temperature at allow the solvent to fully evaporate. The resulting coating thickness is on the order of 5 microns which is about optimum for both squeeze out and bond strength performance. The process can be repeated for coating the second side.

Figure 7A:
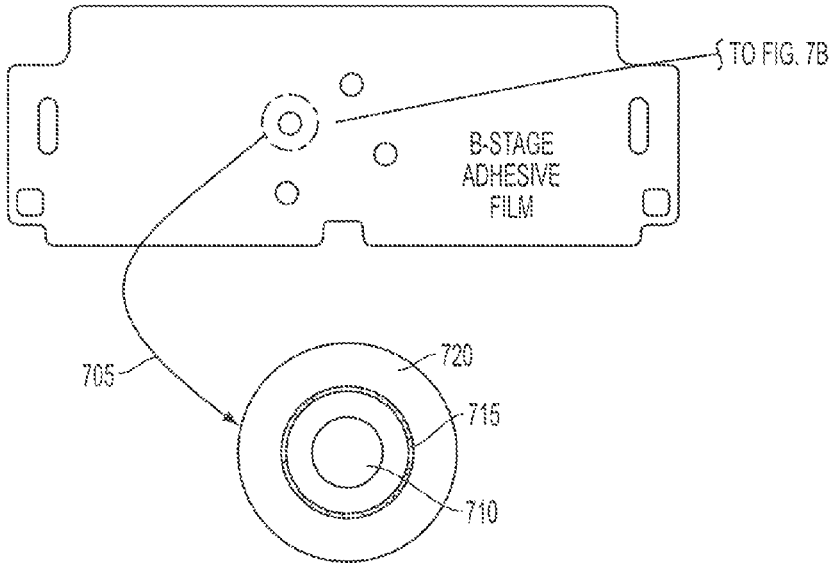
FIG. 7 shows another example method of using two epoxy films on the same jetstack layer in accordance with aspects of the present disclosure.
Figure 7B:
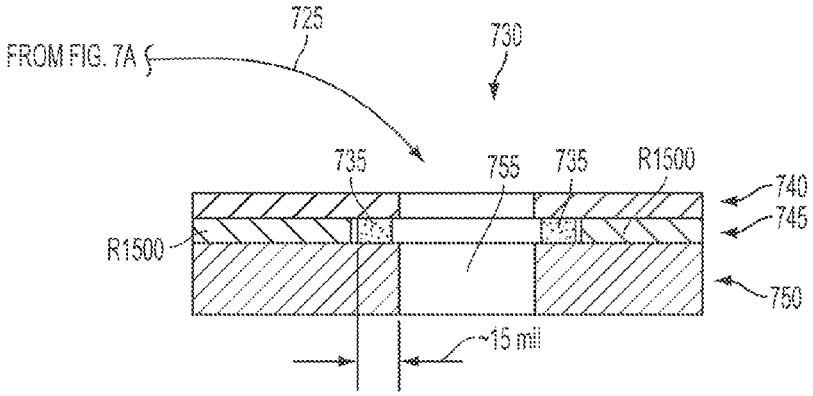

FIG. 7*a* (top view) and FIG. 7*b* (side view) show another example of integrating two adhesive films on one layer. In this example, the compliant wall layer of FIG. 1 is modified using a chemically resistant B-stage epoxy "rings" (cut from film) which are fit into oversized openings in the existing R1500 adhesive film. FIG. 7*a* shows enlarged area 705 of compliant wall layer having P1 opening 710 surrounded by epoxy bead 715 that is surrounded by R1500 opening 720. FIG. 7*b* shows an enlarged area 725 around area 705 in a cross section view. Ink flow path 755 in which ink 730 can flow through inkjet stack. Inkjet stack can include a top layer 740 comprising P1, a middle layer 745 comprising R1500 and liquid epoxy 735 (epoxy 715) bead arranged on either side of ink flow path 755 and a bottom layer 750 comprising a manifold structure. The polymer adhesive may be a crosslinkable acrylic adhesive, or a thermoplastic polyimide, for example. In the examples herein, the polymer adhesive is 81500 adhesive.

Figure 8:
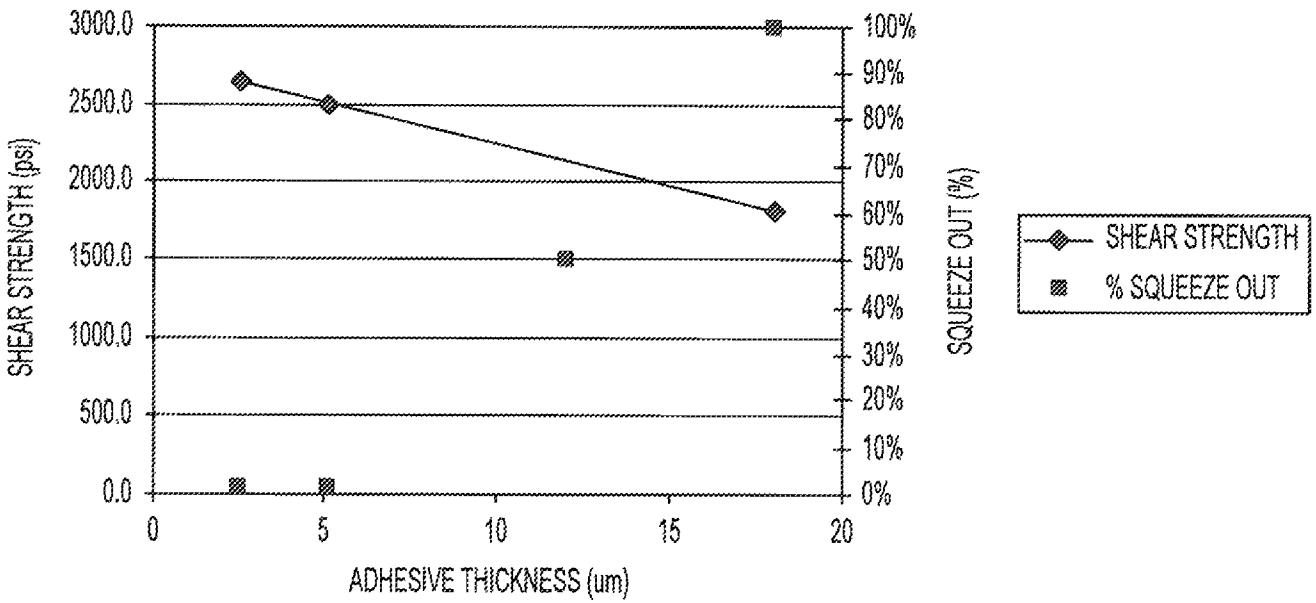
FIG. 8 shows a chart of the Resin Design liquid epoxy that can be cured onto a polyimide film and then used as adhesive film with acceptable bond strength and squeeze out.

FIG. 8 shows a chart showing data, which shows how the Resin Design liquid epoxy can be cured onto a polyimide film and then used as adhesive film with acceptable bond strength and squeeze out.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A printhead assembly arranged to dispense ultraviolet curable ink or gel ink comprising:

a reservoir to hold ultraviolet curable ink or gel ink;

a plurality of functional plates stacked together and comprising a first plate and a second plate adiacent to the first plate;

a first adhesive layer arranged between, and physically contacting, the first plate and the second plate to provide bonding between the first plate and the second plate, wherein the first adhesive layer has a storage modulus between about 100 MPa and 1500 MPa at about 20° C. and between about 3 MPa and 700 MPa at about 120° C.;

a second adhesive layer arranged between, and physically contacting, the first plate and the second plate to provide bonding between the first plate and the second plate;

an ink path for the ultraviolet curable ink or gel ink formed by the first plate, the second plate, and the second adhesive layer, wherein:

the second adhesive layer is exposed to the ink path;

the first adhesive layer is not exposed to the ink path;

the first adhesive layer has a first chemical resistance to the ultraviolet curable ink or gel ink when exposed thereto, the second adhesive layer has a second chemical resistance to the ultraviolet curable ink or gel ink when exposed thereto, where the second chemical resistance is greater than the first chemical resistance; and the second adhesive layer has a storage modulus that is higher than the storage modulus of the first adhesive layer.

2. The printhead assembly of claim 1, wherein the first adhesive layer has a thickness of between about 1 mil and 4 mils.

3. The printhead assembly of claim 1, wherein the second adhesive layer has a thickness of between about 1 mil and 4 mils.

4. The printhead assembly of claim 1, wherein the first adhesive layer includes a crosslinkable acrylic adhesive.

5. The printhead assembly of claim 1, wherein the first adhesive layer includes a thermoplastic polyimide.

6. The printhead assembly of claim 1, wherein the functional plates are formed of a metal, ceramic, or plastic material.

7. The printhead assembly of claim 1, wherein the second adhesive layer includes epoxies or thermoplastic polyimide.

* * * * *